US007276033B2

(12) United States Patent
Phillips

(10) Patent No.: US 7,276,033 B2
(45) Date of Patent: Oct. 2, 2007

(54) RHYTHMIC BLOOD PRESSURE MODULATION AND LEGSHAKING APPARATUS

(75) Inventor: Edward H. Phillips, Troy, MI (US)

(73) Assignee: RLE Corporation, Troy, MI (US)

( * ) Notice: Subject to any disclaimer, the term of this patent is extended or adjusted under 35 U.S.C. 154(b) by 21 days.

(21) Appl. No.: 11/204,813

(22) Filed: Aug. 16, 2005

(65) Prior Publication Data

US 2006/0035769 A1 Feb. 16, 2006

Related U.S. Application Data

(60) Provisional application No. 60/602,028, filed on Aug. 16, 2004, provisional application No. 60/607,692, filed on Sep. 7, 2004, provisional application No. 60/623,779, filed on Oct. 29, 2004.

(51) Int. Cl.
*A61H 1/00* (2006.01)

(52) U.S. Cl. ..... 601/23; 601/24; 601/26

(58) Field of Classification Search ..... 601/24, 601/89, 90, 100, 23, 26; 482/97, 137, 142
See application file for complete search history.

(56) References Cited

U.S. PATENT DOCUMENTS 3,876,198 A * 4/1975 Seligman ..... 482/137
4,403,773 A 9/1983 Swann
4,546,967 A * 10/1985 Kecala ..... 482/145
4,659,077 A 4/1987 Stropkay
4,746,114 A * 5/1988 Grider ..... 482/104
5,029,848 A 7/1991 Sleamaker
5,449,336 A 9/1995 Sabel
5,496,246 A 3/1996 Pierre
5,531,658 A * 7/1996 L. S. C. ..... 482/142
5,820,519 A 10/1998 Slenker
6,228,004 B1 5/2001 Steinback et al.
6,605,024 B2 * 8/2003 Stearns ..... 482/142
7,004,891 B2 * 2/2006 Morris et al. ..... 482/101

OTHER PUBLICATIONS

Brochure entitled "EECP Treatment," an education service of Vasomedical, Inc.; Relief from Angina; 7 pages.
Brochure entitled "EECP—A New Therapy For Angina Pectoris," (A Patient's Guide to Enhanced External Counterpulsation), by Vasomedical, Inc;. Heartbeat, vol. 3, No. 2, pp. 1-4.

* cited by examiner

*Primary Examiner*—Michael Brown
(74) *Attorney, Agent, or Firm*—Gifford, Krass, Sprinkle, Anderson & Citkowski, P.C.

(57) ABSTRACT

Resonant and powered rhythmic blood pressure modulation (hereinafter "RBPM") and "Legshaking" apparatus are provided for implementing either hand or powered RBPM, or Legshaking operation as intended for therapeutic treatment of cardiovascularly or neurologically compromised patients via enhancing blood flow through portions of a patient's cardiovascular system comprised in his or her torso, neck and head and specifically through, or around, partially clogged coronary arteries as well as through, or around, "plaques and tangles" in the arteries of his or her brain.

16 Claims, 8 Drawing Sheets

RHYTHMIC BLOOD PRESSURE MODULATION AND LEGSHAKING APPARATUS

RELATED APPLICATIONS

This application claims priority of U.S. Provisional Patent Application Ser. Nos. 60/602,028 filed Aug. 16, 2004, 60/607,692 filed Sep. 7, 2004, and 60/623,779 filed Oct. 29, 2004.

BACKGROUND OF THE INVENTION

The present invention relates generally to apparatus for enhancing the status of cardiac and cerebral health in the human body, and more particularly to method and apparatus for implementing rhythmic blood pressure modulation generally suitable for enhancing blood flow through portions of the cardiovascular system comprised in the torso, neck and head, and specifically through, or around, partially clogged coronary arteries as well as through arteries of the brain.

Cardiovascular disease eventually kills at least four out of every 10 Americans. Conventional treatment tends to rely on suppressing symptoms with drugs or invasive procedures including balloon angioplasty, stent placement and bypass surgery. Alternately, a totally non-invasive procedure known as Enhanced External Counter Pulsation (hereinafter "EECP") is just now beginning to be used in conventional cardiovascular practice. EECP involves a patient lying supinely (e.g., face up in a nominally horizontal position) with pressure cuffs around his or her calves, and thighs. Then an intermittent pressure source inflates and deflates the cuffs in a sequential manner in synchronism with the patient's heartbeat as controlled by electronic apparatus receiving appropriate signals therefor from EKG apparatus also applied to the patient. Generally, the concept is to effect impulses of increased blood pressure by forcing blood toward the patient's torso and head in synchronism with his or her heartbeat. According to a pamphlet entitled "EECP Treatment" available from Vascomedical Inc. of Westbury, N.Y. this procedure may enable the patient's heart to self create collateral circulation around partially clogged coronary arteries.

Still more recently and in accordance with a claimed "method for enhancing a patient's cardiovascular activity and health" as fully described in U.S. Pat. No. 6,261,250 B1 entitled METHOD AND APPARATUS FOR ENHANCING CARDIOVASCULAR ACTIVITY AND HEALTH THROUGH RHYTHMIC LIMB ELEVATION and issued to Edward H. Phillips on Jul. 17, 2001, it has been found that substantially the same benefits (e.g., self creation of collateral circulation around partially clogged coronary arteries) can be attained at any time in any venue by virtually any patient via his or her unassisted utilization of synchronous rhythmic limb elevation (hereinafter "RLE") apparatus. In such use synchronous RLE operation is employed via synchronously elevating and lowering all four of the patient's limbs at a relatively modest frequency of perhaps 20 to 25 cycles per minute. In view of the fact that the claimed "method for enhancing a patient's cardiovascular activity and health" and its benefits are fully described in the '250 patent, that patent is expressly incorporated herein by reference and thus the method and its benefits with respect to heart disease need not be further described herein.

Of additional interest herein however, is the fact that a number of studies have shown that from relatively early ages most people begin to accumulate the "plaques and tangles" characteristic of Alzheimer's, Parkinson's and other neurological diseases in the arteries of their brains. This of course results in an early abnormal death rate of brain cells unless a method for improving blood circulation in the brain can be provided. In fact, some 4.5 million Americans are estimated to have Alzheimer's disease already with perhaps as many as another 1.5 million having Parkinson's disease as well. Fortunately, most are still in the early stages where progress of these diseases might be materially delayed by improved blood circulation in the brain. In this regard, it has been suggested that a "lifestyle comprising daily exercise" can enable one to materially delay, or possibly even eliminate, the onset and progression of these diseases. In fact, there is a plethora of published papers relating to the relationship between diminished blood flow to the brain and Alzheimer's, Parkinson's, Multiple Sclerosis, Lupus, Cerebral Palsy and practically every other neurological disease one can think of. The problem has been that while the medical community on all continents has been writing about this problem, until recently conducted experiments with EECP (e.g., yet to be published) nobody has been doing anything about it. Because of the improved blood circulation in the torso, neck and head uniquely resulting from synchronous RLE, it is believed herein that synchronous RLE could well be a preferred therapeutic exercise for treatment of all of these neurological diseases.

On the other hand, there has been some reluctance to accept synchronous RLE for these purposes because synchronous RLE apparatus is somewhat bulky, complex and formidable in operation. In fact, it has been found experimentally that some neurological disease patients have considerable difficulty in efficiently operating synchronous RLE apparatus. For instance, one of the characteristic problems that plagues many Parkinson's patients is a form of rigidity brought on by virtually any form of stress. It has been found that even the relatively simple tasks of donning leg and arm supporting straps and turning on the synchronous RLE apparatus can create such stress often resulting in rigidity that substantially defeats the RLE concept described above.

What is needed is rhythmic blood pressure modulation (hereinafter "RBPM") apparatus that is able to provide the substantially the same, or even further enhanced levels of blood flow through portions of cardiovascular system comprised in the torso, neck and head, and specifically through, or around, partially clogged coronary arteries as well as through the arteries of the brain—but that at the same time is significantly smaller and simpler to operate with no coordinated muscle activity required. Therefore, objects of the present invention include providing suitable RBPM apparatus for enabling RBPM, and through utilization thereof, a method for enhancing blood flow through portions of cardiovascular system comprised in the torso, neck and head, and specifically through, or around, partially clogged coronary arteries as well as through the arteries of the brain.

SUMMARY OF THE INVENTION

These and other objects are achieved via utilization of simple RBPM apparatus by a supinely disposed patient in implementing a longitudinal rocking motion of his or her whole body. For instance, alternate longitudinally rocking resonant full body length bench assemblies are provided therefor in a preferred embodiment of the present invention while first and second types of powered RBPM apparatus are provided in first and second preferred embodiments. Further, methods for enhancing blood flow through portions of the patient's cardiovascular system comprised in his or her torso, neck and head, and specifically through, or around, partially clogged coronary arteries as well as through the arteries of his or her brain are provided in a third alternate preferred embodiment of the present invention. The RBPM apparatus described herein are differentiated from RLE apparatus presented in the incorporated '250 patent in that avoid use of limb supporting lines, and further, they utilize self-contained resonant or drive assemblies, and thus avoid use of an exposed frame, gearmotor, crank, and arm and leg tow lines similar to those comprised in the synchronous RLE apparatus presented in the incorporated '250 patent.

A first type of self-energized resonant RBPM apparatus is provided in accordance with the preferred embodiment of the present invention. The first type of self-energized resonant RBPM apparatus comprises a longitudinally rocking full body length bench assembly mounted upon longitudinally oriented traditional rockers nominally positioned under the combined centers of gravity of an average patient and the bench assembly. Thus, they are literally rocking bench assemblies having a substantially sinusoidal rocking motion whose natural frequency is determined by the equation $$f_n=(½_)Sqrt\ [(g\ a)/(((b^2+c^2)/12)+d^2)]$$

where $f_n$ is the natural frequency, g is the acceleration of gravity, a is the nominal vertical distance between the rotational center of the rockers and the combined centers of gravity of the patient and the bench assembly, b and c are the height and length of a rectangular parallelepiped nominally representative of the patient and the bench assembly, and d is the nominal vertical distance between the combined centers of gravity of the patient and the bench assembly and the supporting surface (i.e., the floor).

A second type of self-energized resonant RBPM apparatus is also provided wherein a longitudinally rocking full body length bench assembly is mounted upon a longitudinally oriented four-bar rocking linkage assembly that is also nominally positioned under the combined centers of gravity of an average patient and the bench assembly. Similarly, it is also a rocking bench assembly having a substantially sinusoidal rocking motion comprising significant longitudinal motion of the patient. However, determination of its natural frequency is considerably more involved as will be developed in detail below.

Either of the first or second types of self-energized resonant RBPM apparatus are activated via moving a mass element synchronously at the natural rocking frequency in a longitudinal direction in order to "pump" either bench assembly similarly to the manner in which one "pumps" a swing. By experimentation with heart patients it has been found that a natural rocking frequency range of from 20 to 25 cycles per minute is preferable, and for instance, can be obtained in the first type of self-energized resonant RBPM apparatus via utilizing nominally practical values for the lengths b, c and d whereby the bench assembly is configured such that the length a is in the order of 20 inches.

A third type of self-energized resonant RBPM apparatus is also provided in accordance with the preferred embodiment of the present invention wherein the bench assembly similarly comprises longitudinally oriented rockers nominally positioned under the combined centers of gravity of an average patient and the bench assembly. In the third type of self-energized resonant RBPM apparatus however, the rockers are constrained to roll upon rails affixed to a base structure. One activates the third type of self-energized resonant RBPM apparatus by forcibly pushing and/or pulling at least one stationary handle mounted on the base structure.

Powered RBPM apparatus comprising a powered longitudinally pivoting full body length bench assembly is provided in accordance with a first alternate preferred embodiment of the present invention wherein such bench assemblies are pivotally mounted with respect to a base structure by first and second supporting arms. The first and second supporting arms are positioned such that a nominal pivot point is formed at a projected virtual location generally coincident with lower portions of the torso of an average patient. In a preferred type of drive assembly, a Scotch yoke mechanism is mounted within a space between the first and second supporting arms.

Alternate drive assemblies are also presented however. They include a crank and connecting rod mechanism, and a variety of a linear drive assemblies such as a rack and pinion gear set or a leadscrew and leadscrew nut assembly, or even a hydraulic drive comprising a motor driven pump and a cylinder. In any of the linear drive assemblies however; an electronically controlled motor would be required wherein control of the motor would have to be affected in concert with signals indicative of instant positions of the bench assembly. Thus, if one were to utilize any of the linear drive assemblies absolute fail-safe position measurement and control methods would have to be incorporated in order to guarantee fail-safe operation of the RBPM apparatus. The advantage in using such an approach however, is that stroke lengths could be electronically selected as opposed to utilizing the manually adjusted slide mechanism described below that is used in conjunction with the drive assembly utilizing a Scotch yoke mechanism.

In any of the above-described RBPM apparatus the platform of the bench assembly could of course be formed in an articulated manner similarly to a hospital bed or gurney. Then a patient would still be able to assume a nominally supine position but selectively elevate his or her torso, neck and head, and/or his or her knees with respect to his or her hips when lying on the bench assembly. In the case of any of self-energized resonant RBPM apparatus however, the rocking frequency would be somewhat reduced by virtue of the distance between the rotational center of the rockers and the so repositioned combined centers of gravity of the patient and the bench assembly being reduced as a consequence of the patient elevating some portions of his or her anatomy.

In any case, methods for enhancing blood flow through portions of a patient's cardiovascular system comprised in his or her torso, neck and head, and specifically through, or around, partially clogged coronary arteries as well as through the arteries of his or her brain are presented in a second alternate preferred embodiment of the present invention, wherein apparatus comprising a longitudinally rocking or pivoting full body length bench assembly for supporting and rhythmically rocking or pivoting the patient's whole body in a longitudinal direction is provided, and wherein the methods all comprise the fundamental steps of: the patient lying on the bench assembly in a nominally supine manner; and causing proximal and distal portions of the patient and bench assembly to alternately elevate and fall with respect to one another in a longitudinally rocking or pivoting manner.

Rhythmic modulation of blood flow into torso, neck and head portions of a patient's cardiovascular system is believed herein to occur as a result of gravity effects. Simply put, blood rushes from the lower limbs toward and into the torso, neck and head as the distal portion of any of the above described longitudinally rocking or pivoting full body length bench assemblies is elevated with respect to the proximal portion, and then reverses when it is lowered. This is naturally accompanied by significant localized changes in blood pressure. By way of example, if the differential elevation between a patient's feet and head is varied over a range of 32 inches there is a corresponding differential rhythmic modulation of blood pressure between the feet and head over a range of about 62 mm Hg. There is less differential rhythmic modulation of blood pressure between the feet and the heart of course because the heart is closer to the feet. Still, in this example of differential elevation between a patient's feet and head being varied over a range of 32 inches the corresponding differential rhythmic modulation of blood pressure between the feet and the heart would perhaps be 45 mm Hg.

As opposed to the above however, it is believed herein that Parkinson's, and possibly other neurological disease patients, may need a different form of treatment that appears to interrupt neural commands that result in the rigidity cited above. Juan Contreras of Santiago, Chile conceived this form of treatment in basic manual form in order to overcome his extreme rigidity seizures. He referred to this procedure by the coined term "legshaking". As that name implies, the treatment consists of a patient laying in a supine position and a therapist picking up the patient's legs, and shaking them as violently as possible for as long as possible, or at least until his or her seizure subsides.

It is simply not possible for a therapist to implement this procedure for very long. Thus, "Legshaking" apparatus capable of implementing the legshaking procedure is presented in a third alternate preferred embodiment of the present invention, wherein apparatus similar to the powered RBPM apparatus of the first alternate preferred embodiment of the present invention is presented. In this case however, the bench assembly is bifurcated with its head and torso-supporting portion being stationary and its leg-supporting portion supported by first and second supporting arms that are positioned such that a nominal pivot point is formed at a projected virtual location generally coincident with hip joint of an average patient.

In a first aspect then, the present invention is directed to providing rhythmic blood pressure modulation or RBPM apparatus for use by a supinely disposed patient for implementing RBPM motions of his or her entire body, wherein a longitudinally rocking full body length bench assembly is provided for supporting the supinely disposed patient, and further wherein the RBPM apparatus is enabled for executing a rhythmically implemented rocking motion of the bench assembly.

In a second aspect, the present invention is directed to the RBPM apparatus of the first aspect wherein the RBPM apparatus is configured as a self-energized resonant RBPM apparatus via mounting the longitudinally rocking full body length bench assembly upon longitudinally oriented traditional rockers nominally positioned under the combined centers of gravity of an average patient and the bench assembly, whereby the patient's whole body is enabled for execution of a rocking motion in a longitudinally resonant manner.

In a third aspect, the present invention is directed to the self-energized resonant RBPM apparatus of the second aspect wherein a nominally vertical distance between the rotational center of the rockers and the combined centers of gravity of the patient and the bench assembly is in the order of 20 inches.

In a fourth aspect, the present invention is directed to the self-energized resonant RBPM apparatus of the first aspect wherein the RBPM apparatus is configured as a self-energized resonant RBPM apparatus via mounting the longitudinally rocking full body length bench assembly upon a longitudinally oriented four-bar rocking linkage assembly nominally positioned under the combined centers of gravity of an average patient and the bench assembly, whereby the patient's whole body is enabled for execution of a rocking motion in a longitudinally resonant manner.

In a fifth aspect, the present invention is directed to the self-energized resonant RBPM apparatus of either of the second or fourth aspects further wherein a nominally longitudinally movable mass element is provided for enabling a patient to "pump" the self-energized resonant RBPM apparatus at the natural rocking frequency.

In a sixth aspect, the present invention is directed to the self-energized resonant RBPM apparatus of either of the second or fourth aspects further wherein at least one handle mounted upon a base structure is provided for enabling a patient to forcibly drive the self-energized resonant RBPM apparatus at the natural rocking frequency.

In a seventh aspect, the present invention is directed to providing powered rhythmic blood pressure modulation or RBPM apparatus for use by a supinely disposed patient for implementing RBPM motions of his or her entire body, comprising: a longitudinally pivoting full body length bench assembly pivotally supported from a base structure by first and second supporting arms positioned such that a nominal pivot point is formed at a projected virtual location generally coincident with lower portions of the torso of an average patient; and a drive assembly for driving the bench assembly in a rhythmically implemented longitudinally pivoting manner.

In an eighth aspect, the present invention is directed to a method for enhancing blood flow through portions of a patient's cardiovascular system comprised in his or her torso, neck and head, and specifically through, or around, partially clogged coronary arteries as well as through the arteries of his or her brain, wherein apparatus comprising a longitudinally rocking or pivoting full body length bench assembly for supporting and rhythmically rocking or pivoting the patient's whole body in a longitudinal direction is provided, and wherein the method comprises the steps of: the patient lying on the bench assembly in a nominally supine manner; and causing proximal and distal portions of the patient and bench assembly to alternately elevate and fall with respect to one another in a longitudinally rocking or pivoting manner.

In a ninth aspect, the present invention is directed to providing powered legshaking apparatus for use by a supinely disposed patient for implementing legshaking motions of his or her legs, comprising: a bifurcated bench assembly having its head and torso-supporting portion fixedly mounted upon a base structure; its leg-supporting portion pivotally supported from the base structure by first and second supporting arms positioned such that a nominal pivot point is formed at a projected virtual location generally coincident with hip joint of an average patient; and a drive assembly for driving the leg-supporting portion in a rhythmically implemented longitudinally pivoting manner with respect to the base structure.

In a tenth aspect, the present invention is directed to the powered RBPM apparatus of either of the seventh or ninth aspects wherein the drive assembly comprises a gearmotor mounted upon the base structure, and further wherein the gearmotor is drivingly coupled to the bench assembly via a Scotch yoke assembly.

In an eleventh aspect, the present invention is directed to the powered RBPM apparatus of either of the seventh or ninth aspects wherein the drive assembly comprises a gearmotor mounted upon the base structure, and further wherein the gearmotor is drivingly coupled to the bench assembly via a crank and connecting rod.

In a twelfth aspect, the present invention is directed to the powered RBPM apparatus of either of the seventh or ninth aspects wherein the drive assembly is a linear drive assembly comprising a gearmotor, position measuring apparatus and a controller wherein the controller establishes closed loop control over instant positions of the drive assembly via active control of the gearmotor in response to position signals emanating from the position measuring apparatus.

In a thirteenth aspect, the present invention is directed to the powered RBPM apparatus of the twelfth aspect wherein the drive assembly additionally comprises a rack and pinion gear set.

In a fourteenth aspect, the present invention is directed to the powered RBPM apparatus of the twelfth aspect wherein the drive assembly additionally comprises a leadscrew and leadscrew nut sub-assembly.

In a fifteenth and final aspect, the present invention is directed to the powered RBPM apparatus of the twelfth aspect wherein the drive assembly additionally comprises hydraulic drive apparatus including a motor driven pump and a cylinder.

BRIEF DESCRIPTION OF THE DRAWING

A better understanding of the present invention will now be had with reference to the accompanying drawing, wherein like reference characters refer to like parts throughout the several views therein, and in which.

DETAILED DESCRIPTION OF THE PREFERRED EMBODIMENTS

As explained in some detail in the above section entitled "Background of the Invention", rhythmic modulation of blood flow into torso, neck and head portions of a patient's cardiovascular system is believed herein to be beneficial in therapeutic treatment protocols for heart disease as well as a wide range of neurological diseases. Described hereinbelow are a number of apparatus that can implement such rhythmic modulation of blood flow into torso, neck and head as a result of gravity effects associated with rhythmically moving a patient 22 through a longitudinally rocking motion. Simply put, blood rushes from the lower limbs toward and into the torso, neck and head as the distal portions of the below described longitudinally rocking full body length bench assemblies are elevated with respect to the proximal portion, and then reverses when they are lowered. This is naturally accompanied by significant localized changes in blood pressure. By way of example, if the differential elevation between a patient's feet and head is varied over a range of 32 inches there is a corresponding differential rhythmic modulation of blood pressure between the feet and head over a range of about 62 mm Hg. There is less differential rhythmic modulation of blood pressure between the feet and the heart of course because the heart is closer to the feet. Still, in this example of differential elevation between a patient's feet and head being varied over a range of 32 inches the corresponding differential rhythmic modulation of blood pressure between the feet and the heart would perhaps be 45 mm Hg.

Figure 1:
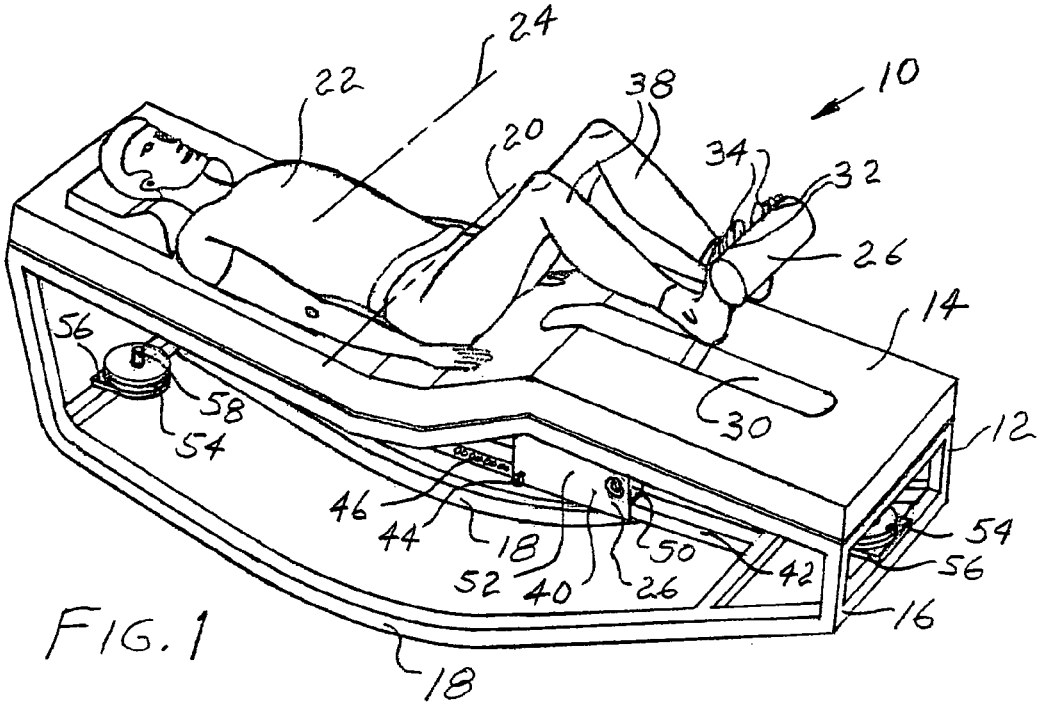
FIG. 1 is a perspective view of a first type of self-energized resonant RBPM apparatus comprising traditional rockers.
Figure 2A:
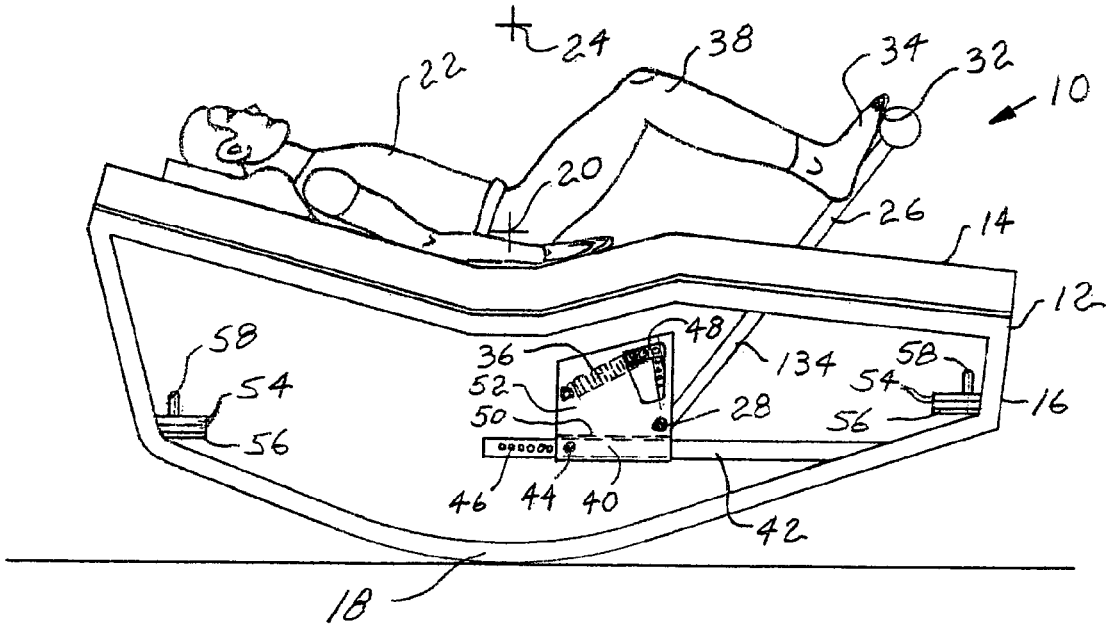
FIGS. 2A, 2B and 2C are side views depicting the range of motion of the self-energized resonant RBPM apparatus depicted in FIG. 1.

Therefore now with reference first to FIGS. 1 and 2A, there shown is a first self-energized resonant RBPM apparatus 10 comprising a longitudinally rocking full body length bench assembly 12 in accordance with the preferred embodiment of the present invention. The bench assembly 12 comprises a cushion 14 supported by a frame 16 which comprises longitudinally oriented traditional rockers 18 nominally positioned under the combined centers of gravity 20 of an average patient 22 and the bench assembly 12. Thus, it is literally a resonant rocking bench assembly 12 having a substantially sinusoidal rocking motion over rocking angles extending to a magnitude of perhaps as much as +/−15 degrees. The natural rocking frequency of the bench assembly 12 can be determined by the equation $$f_n=(60/2_i)\text{Sqrt}\ [(g\ a)/(((b^2+c^2)/12)+d^2)] \quad (1)$$

where $f_n$ is the natural frequency, the number 60 is a conversion factor converting the result from Hz to cycles/min., pi has the well known value 3.14159, g is the acceleration of gravity, a is the nominal vertical distance between the rotational center 24 of the rockers 18 and the combined centers of gravity 20 of the patient 22 and the bench assembly 12, b and c are the height and length of a rectangular parallelepiped nominally representative of the patient 22 and the bench assembly 12, and d is the nominal vertical distance between the combined centers of gravity 20 of the patient 22 and the bench assembly 12 and the supporting surface (i.e., the floor). The first self-energized resonant RBPM apparatus 10 is activated via moving a mass element comprising the feet 34 and legs 38 of the patient 22, and a pedal assembly 26 synchronously at the natural rocking frequency $f_n$ in a longitudinal direction in order to "pump" the rocker mounted bench assembly 12 similarly to the manner in which one "pumps" a swing. The pedal assembly 26 is pivotally mounted upon an axle 28 and protrudes upward through a slot 30 formed in the frame 16 and cushion 14. It has been found that a natural rocking frequency range of from 20 to 25 cycles per minute can be obtained with nominally practical values for the lengths b, c and d by configuring the bench assembly 12 such that the length a is in the order of 20 inches.

Figure 2B:
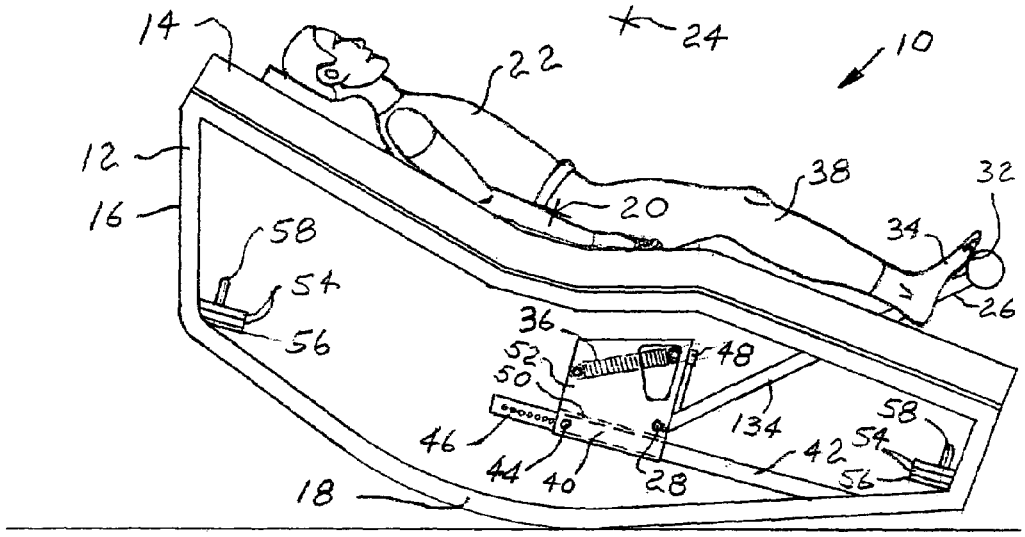
Figure 2C:
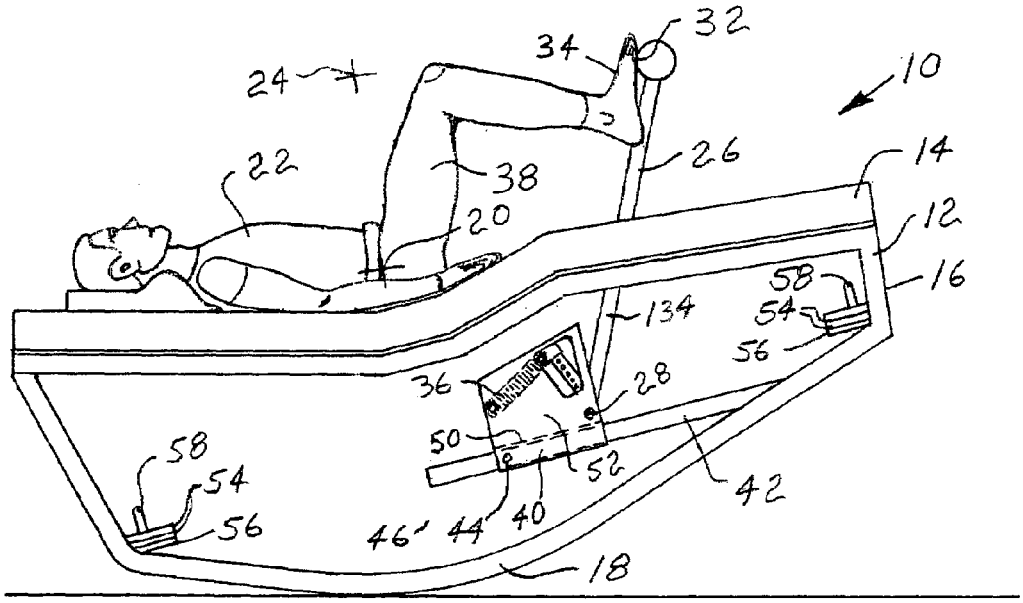

With further reference now to FIGS. 2B and 2C, the patient 22 activates the pedal assembly 26 via selectively pushing a pedal portion 32 thereof with his or her feet 34 against a return force provided by extension spring 36. As the patient 22 repetitively pushes the pedal assembly 26 forward and then allows it to move rearward in accordance with the return force, the combined equivalent longitudinally translating mass of the pedal assembly 26 as well as his or her feet 34 and legs 38 also moves forward and rearward thus implementing the synchronous motion of the bench assembly 12 at its natural frequency as called for above. In actuality, the range of motion depicted in FIGS. 2B and 2C is representative of an extreme pumping effort typically used only for accelerating the bench assembly 12 to a desired motion amplitude. Continuous operation at any selected motion amplitude requires only sufficient pumping for overcoming energy losses incurred by the rolling motion of the rockers 18 over the instant supporting surface.

Figure 3:
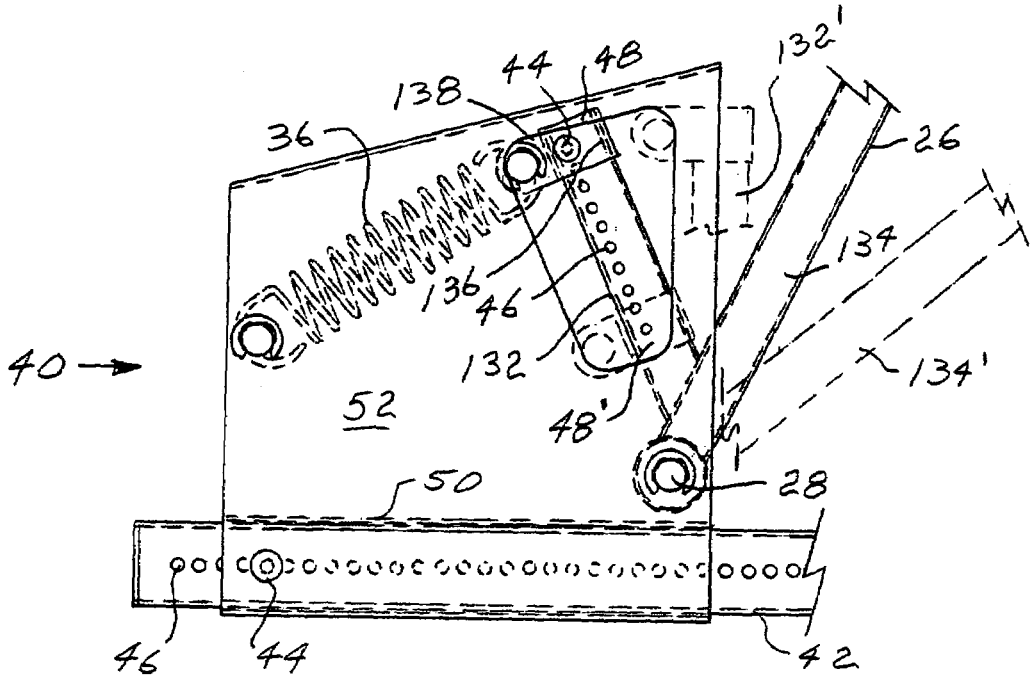
FIG. 3 is a side view of a sliding axle assembly utilized in the self-energized resonant RBPM apparatus depicted in FIGS. 1 and 4.

With further reference now to FIG. 3, the axle 28 is mounted in an exemplary sliding axle assembly 40 that can be adjustably moved to a selected position along a rail member 42 of the frame 16 and then retained in that position by a pin or bolt 44 extending through a selected one of holes 46 in order to accommodate lengths of the legs of any particular patient 22. In addition, the moving end of the extension spring 36 can be selectively positioned with respect to the axle 28 via positioning a spring mounting bracket 48 along a side arm 132 and then retained by another pin or bolt 44 extending through a selected one of another set of holes 46 wherein the side arm is fixedly attached to a main arm 134 of the pedal assembly 26. Thus, the effective return force can be adjusted to suit any particular patient 22 as indicated by the extreme position of a phantom spring mounting bracket 48'. Similarly, phantom side 132' and main arms 134' indicate the possible range of motion of the pedal assembly 26.

The frame 16 could for instance be configured in an exemplary manner as a weldment formed from thin wall structural steel tubing such as 2×2×0.120 square structural steel tubing. In this case, it would be convenient to form the sliding axle assembly 40 as a weldment comprising a tubular member 50 formed from 2-¼×2-¼×0.120 square structural steel tubing and suitable side plates 52. Similarly, the side and main arms 132 and 134 could be formed from 1-¼×1-¼×0.083 square structural steel tubing and the spring mounting bracket 48 could be formed from a tubular member 136 formed from 1-½×1-½×0.120 square structural steel tubing and suitable side plates 138.

In addition, weights 54 similar to free weights commonly used in weight lifting could be mounted on brackets 56 and nominally vertical pins 58 affixed to either end of the frame 16 in order to compensate for anatomical differences in weight distribution between patients 22 prior to them operating the first self-energized resonant RBPM apparatus 10. This could, for instance, be accomplished by simply adding weights 54 at a relatively elevated end until the bench assembly 12 is nominally leveled with the patient 22 thereon prior to operation of the first self-energized resonant RBPM apparatus 10.

Figure 4:
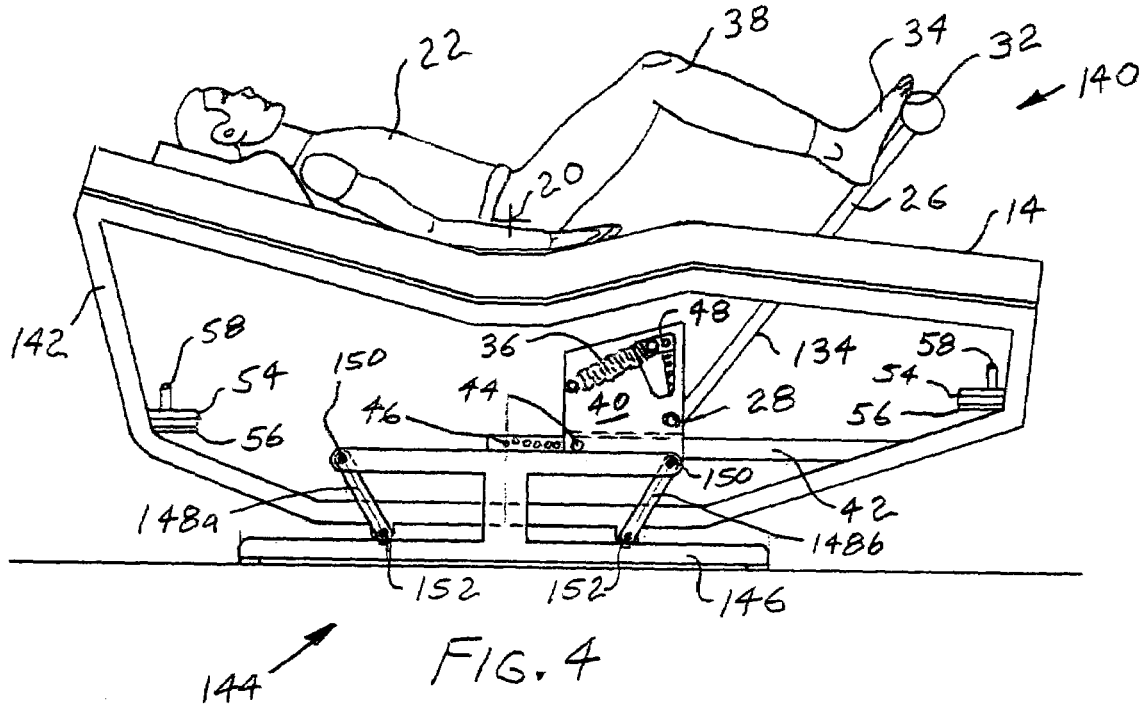
FIG. 4 is a side view of a second type of self-energized resonant RBPM apparatus comprising a four bar linkage assembly.

With reference now to FIG. 4, there shown is a second self-energized resonant RBPM apparatus 140 comprising a longitudinally rocking full body length bench assembly 142 also in accordance with the preferred embodiment of the present invention. The second self-energized resonant RBPM apparatus 140 is functionally similar to the first self-energized resonant RBPM apparatus 10 except that in this case a longitudinally oriented four-bar rocking linkage assembly 144 is utilized in place of the rockers 18 to support the longitudinally rocking full body length bench assembly 142. The four bars comprise the longitudinally rocking full body length bench assembly 142 itself, a base structure 146, and first and second tension links 148*a* and 148*b* where the longitudinally rocking full body length bench assembly 142 is supported from the base structure 146 by the first and second tension links 148*a* and 148*b*. In this case, link supporting pivot points 150 are positioned further apart on the base structure 146 than link supported pivot points 152 on the longitudinally rocking full body length bench assembly 142 such that the first and second tension links 148*a* and 148*b* are disposed in a splayed orientation with respect to one another. It is known that the splayed orientation of the first and second tension links 148*a* and 148*b* results in a stable rocking motion for the second self-energized resonant RBPM apparatus 140. However, determination of its natural frequency is considerably more involved than solving for a simple equation such as equation (1) above.

Figure 5:
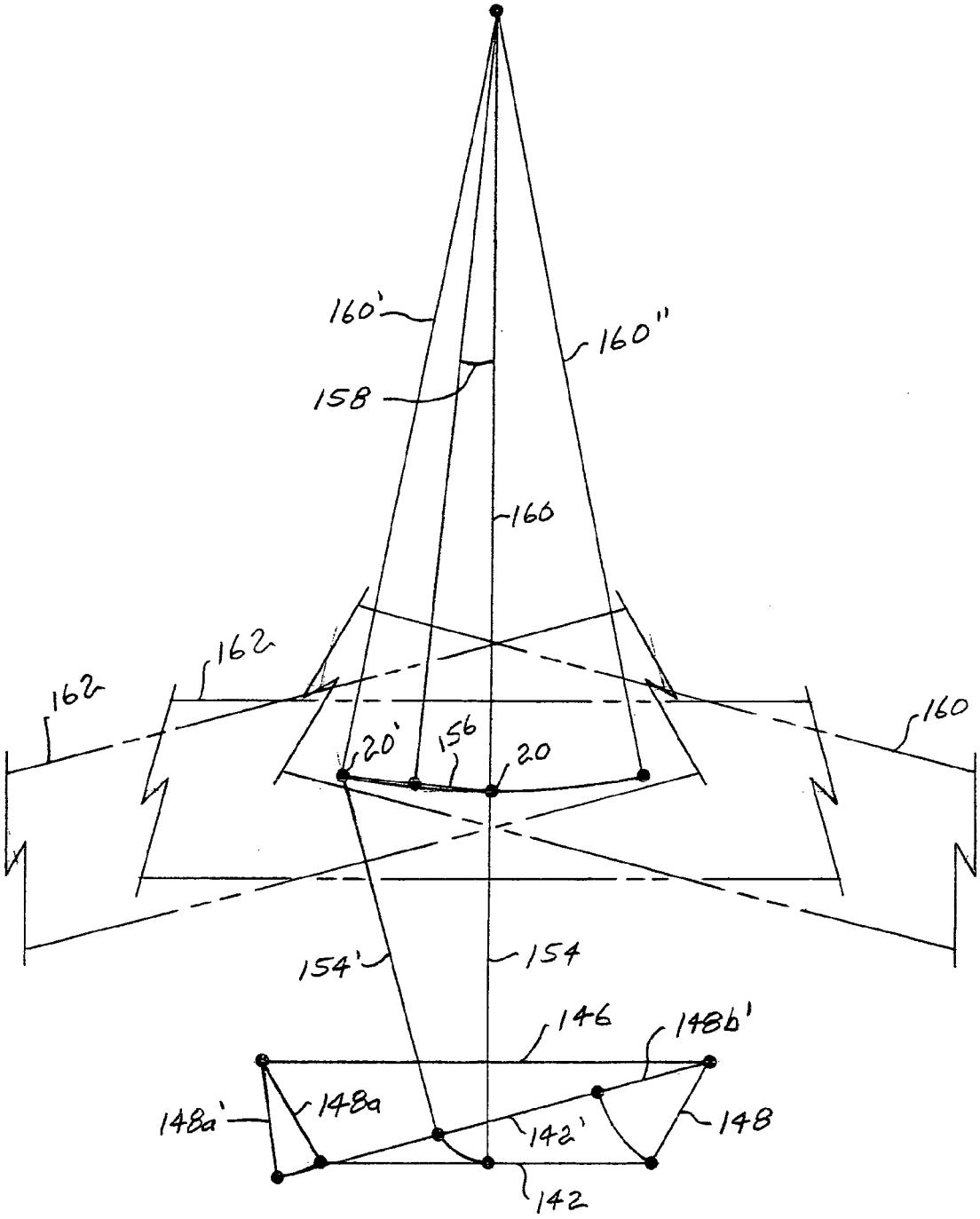
FIG. 5 is a stick drawing useful in analyzing the four bar rocking linkage assembly of FIG. 4.

One method of determining the natural frequency is to find the length of an equivalent pendulum via graphical means. As shown in FIG. 5, this can be done with the aid of a stick drawing wherein the numerical indicators 142, 146, and 148*a* and 148*b* respectively represent the longitudinally rocking full body length bench assembly 142, the base structure 146, and the first and second tension links 148*a* and 148*b*. For simplicity in the following discussion, these numerical indicators will simply be referred to as bars or links 142, 146, and 148*a* and 148*b* along with other details of construction simply being referred to by their line or angle numerical indicator number. The basic structural dimensions assumed for an exemplary four-bar rocking linkage assembly 144 are bar 146=30 in., bar 142=22.168 in., and link 148*a*=link 148*b*=7.832. These values result in neutral splayed angles for the links 148*a* and 148*b* of 30 degrees, and a deflection angle of 15 degrees when the bar 142 and link 148*b* are in alignment as indicated by the combination of link 148*a'*, bar 142' and link 148*b'*. Further assumed is a length of 25 inches from the bar 142 to the combined centers of gravity 20 of an average patient 22 and the bench assembly 142 as depicted by either of lines 154 or 154'. A numerical solution yields a half chordal length 156 of 5.219 in. and a half chordal subtended angle 158 of alpha=5.689 degrees. This results in the length of an equivalent pendulum represented by any of lines 160, 160' or 160" of L=52.65 in. The resulting natural frequency is $$f_n = (60/2_)Sqrt[(12\ gL)/((b^2 + c^2)(15/(2\ \text{alpha}))^2 + 12\ L^2)] \quad (2)$$

$$= 23.6\ \text{cycles/min.}$$

where $f_n$ is again the natural frequency, the number 60 is a conversion factor converting the result from Hz to cycles/min., g is the acceleration of gravity, b and c are the height and length of a rectangular parallelepiped 162 nominally representative of the patient 22 and the bench assembly 12 and assumed here to be 12 in. and 60 in. respectively, alpha and L have the values indicated above, and the factor $(15/(2\ \text{alpha}))^2$ adjusts for the fact that the rectangular parallelepiped 162 rotates through an angle of 15 degrees while the equivalent pendulum only "swings" by an angle of (2 alpha).

Figure 6:
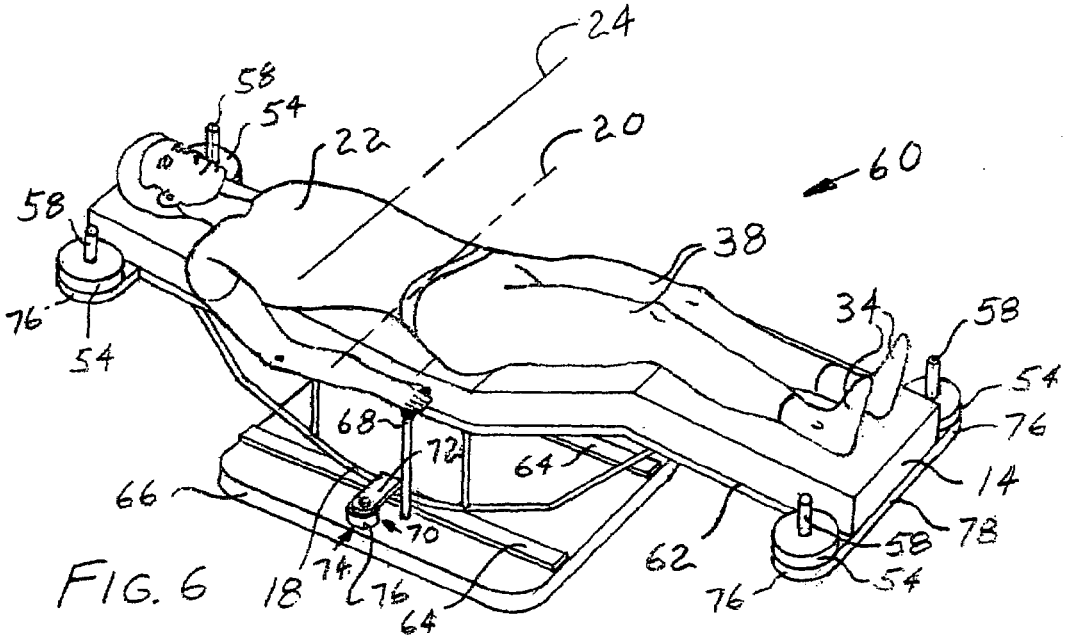
FIG. 6 is a perspective view of a third type of self-energized resonant RBPM apparatus.

With reference now to FIG. 6, there shown is a third self-energized resonant RBPM apparatus 60 comprising a longitudinally rocking full body length bench assembly 62 also in accordance with the preferred embodiment of the present invention. The third self-energized resonant RBPM apparatus 60 is functionally similar to the first self-energized resonant RBPM apparatus 10 except that in this case the rockers 18 roll back and forth on rails 64 affixed to a base plate 66 whereby a patient 22 can operate the third self-energized resonant RBPM apparatus 60 via alternately pushing and pulling on at least one handle 68 affixed to the base plate 66. In the third self-energized resonant RBPM apparatus 60 it is of course necessary to maintain a preferred position of the rockers 18 and bench assembly 62 with respect to the base plate 66 in order to maintain engagement of the rockers 18 with the rails 64.

Figures 7A, 7B, 7C:
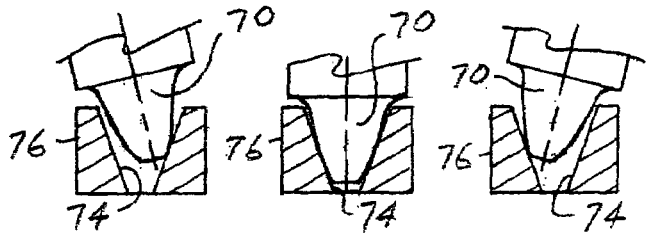
FIGS. 7A, 7B and 7C are sectional views of a gear tooth and receptacle therefor that can be utilized in the third self-energized resonant RBPM apparatus.

An exemplary method of locationally positioning the rockers 18 and bench assembly 62 with respect to the rails 64 utilizes single teeth 70 mounted under brackets 72 affixed at the centers of each of the rockers 18 for engaging holes 74 formed in a pair of receptacles 76 mounted on either side of the base plate 66. As shown in FIGS. 7A, 7B and 7C, it is convenient to form the teeth 70 as round parts having an involute tooth profile and then form the holes 74 with a matching conical shape such that in cross section they mimic a space between teeth of a matching gear rack. And although not shown, the same results could be obtained in reverse via utilizing conical teeth 70' upwardly protruding from the base plate 66 engaging holes 74' formed in brackets 72' that mimic spaces between compatible involute tooth profiles mounted proximate to the centers of each of the rockers 18.

Similarly to the first and second self-energized resonant RBPM apparatus 10 and 140, weights 54 can again be used to compensate for anatomical differences in weight distribution between patients 22 prior to them operating the third self-energized resonant RBPM apparatus 60. An alternate placement of the weights 54 is depicted in FIG. 6 however. In this case they are mounted on brackets 78 comprised in the bench assembly 62.

Figure 8A:
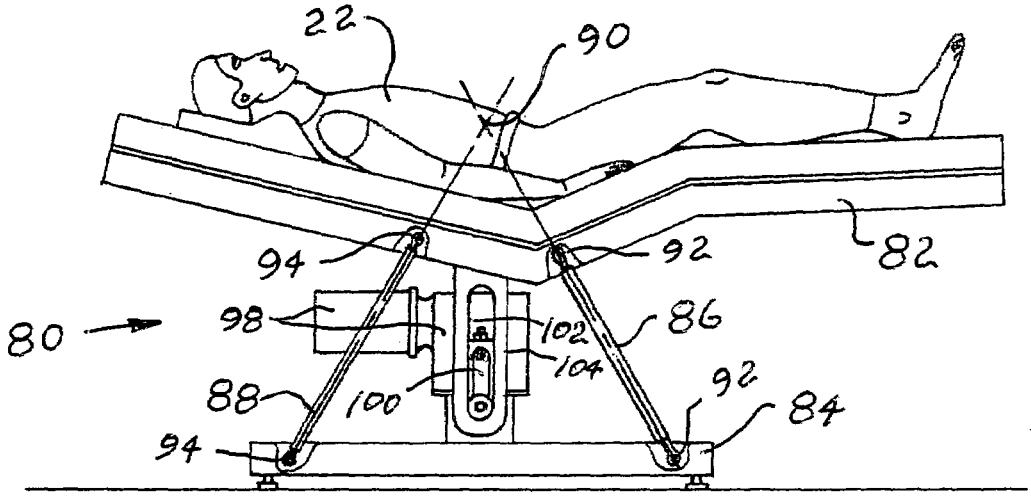
FIGS. 8A, 8B and 8C are side views of a powered RBPM apparatus comprising a powered longitudinally pivoting full body length bench assembly and depicting its the range of motion.
Figure 8B:
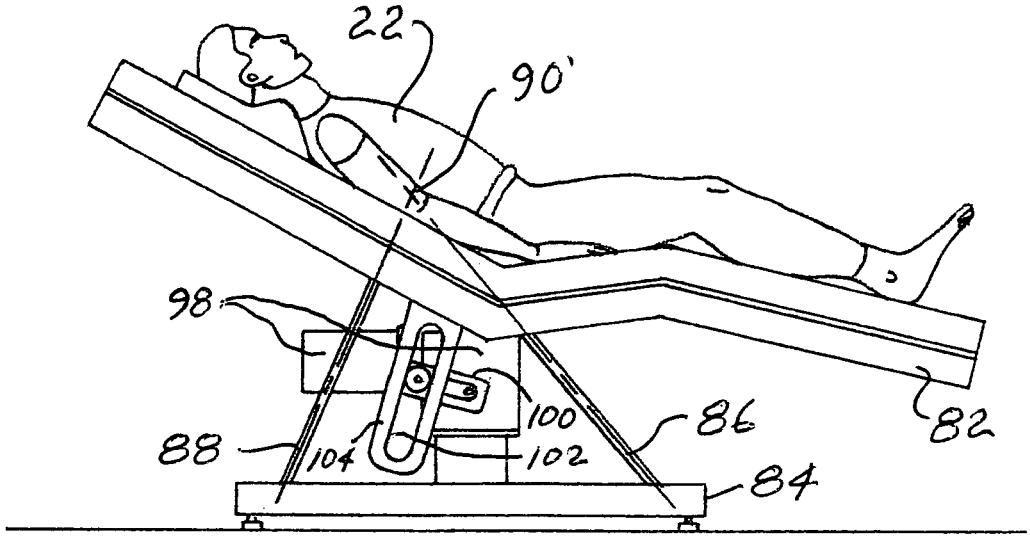
Figure 8C:
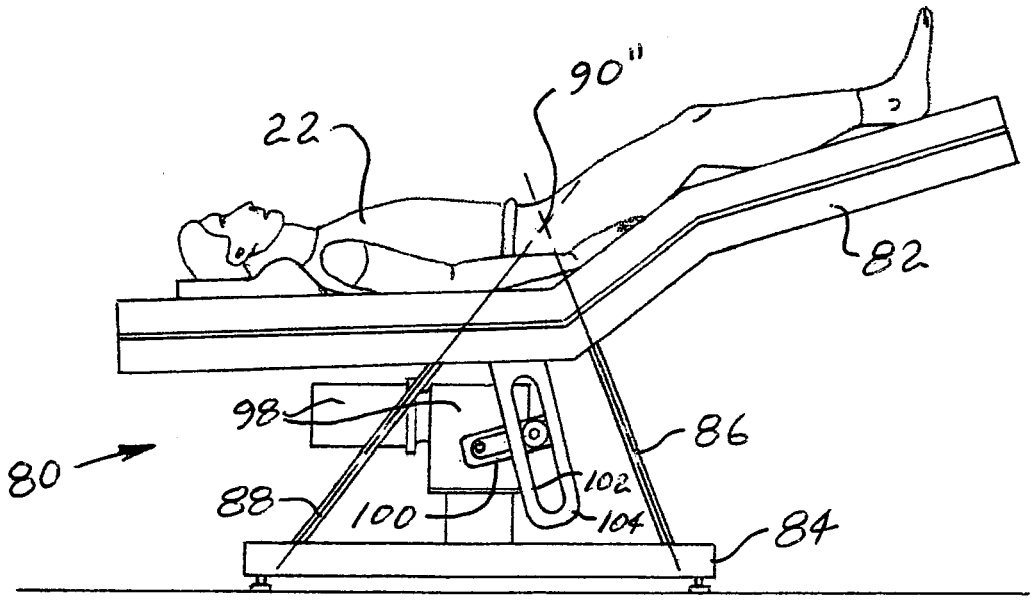

With reference now to FIGS. 8A, 8B and 8C, there shown is a powered RBPM apparatus 80 comprising a powered longitudinally pivoting full body length bench assembly 82 in accordance with a first alternate preferred embodiment of the present invention. The bench assembly 82 is pivotally mounted with respect to a base structure 84 by first and second supporting arms 86 and 88 set in a splayed manner as depicted particularly in FIG. 8A. This results in a nominal center of rotation 90 located at the intersection of projected lines through their respective rod ends 92 and 94. Preferably the first supporting arm 86 is mounted on the base structure 84 by a first set of two rod ends 92 and supports the bench assembly 82 via a second set of two more rod ends 92, where the first and second sets of rod ends 92 are located in and out of the plane of the two-dimensional drawings at opposite sides of the base structure 84 and bench assembly 82. Then preferably the second supporting arm 88 is mounted on the base structure 84 by a single rod end 94 and similarly supports the bench assembly 82 via a single rod end 94. As a result, the nominal center of rotation 90 of the bench assembly 82 is located at a location generally coincident with lower portions of the torso of an average patient 22.

Figure 9:
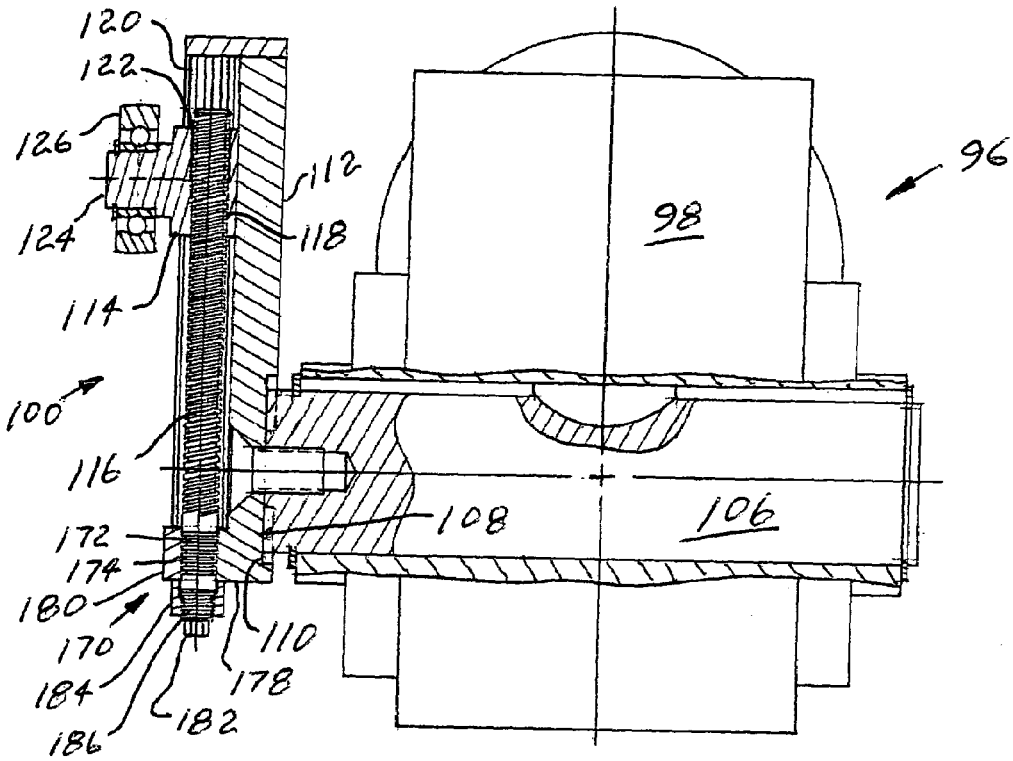
FIG. 9 is a sectional view of an adjustable crank arm utilized in a Scotch yoke drive assembly comprised in the powered RBPM apparatus of FIGS. 8A, 8B and 8C.

As depicted in FIG. 9, the bench assembly 82 is preferably driven by a Scotch yoke drive assembly 96 comprising a drive gearmotor 98, adjustable length crank arm 100 and nominally vertical slot 102 formed in a slot plate 104. The drive gearmotor 98 is fixedly mounted on the base structure 84 and the slot plate 104 is fixedly mounted on the bench assembly 82. The drive gearmotor 98 is preferably a through bore type. This enables the adjustable length crank arm 100 to be mounted directly upon a through bore bar 106 and driven by indexing features 108 formed on the end of the through bore bar 106 via mating indexing features 110 formed on the underside of the adjustable length crank arm 100.

The adjustable length crank arm 100 comprises a way member 112, slide member 114 and a leadscrew 116. Preferably, the way and slide members 112 and 114 comprise opposing interlocking complementary thread ribs and grooves 120 and 122 in order to form a compact overall structure able to withstand high values of longitudinal and transverse loading. The slide member 114 is formed with an integral post 124 for supporting a cam follower 126. Leadscrew nut threads 118 formed within the slide member 114 are used to drivingly couple the leadscrew 116 to the slide member 114. High trust loads imposed upon the leadscrew 116 are transferred to the way member 112 by a unique thrust bearing assembly 170.

The thrust bearing assembly 170 comprises zero-lead male threads 172 formed on the leadscrew 116 engaging complementary zero-lead female threads 174 formed within a split nut member 176. In this case, half of the zero-lead female threads 174 of the split nut member 176 are formed in a forward portion 178 of the way member 112, and the other half are formed in a cap 180. In general, the leadscrew 116 is wrench driven via a hexagonal protrusion 182 formed on the proximate end thereof in order to position the slide member so as to obtain an instantly desired magnitude of pivoting motion. Then the leadscrew 116 is locked in position via a jam nut 184 disposed upon male threads 186 also formed upon the leadscrew 116.

Thus a general method for enhancing blood flow through portions of a patient's cardiovascular system comprised in his or her torso, neck and head, and specifically through, or around, partially clogged coronary arteries as well as through the arteries of his or her brain, wherein apparatus comprising a longitudinally rocking or pivoting full body length bench assembly for supporting and rhythmically rocking or pivoting the patient's whole body in a longitudinal direction is provided in a second alternate preferred embodiment of the present invention, wherein the general method comprises the steps of: the patient lying on the bench assembly in a nominally supine manner; and causing proximal and distal portions of the patient and bench assembly to alternately elevate and fall with respect to one another in a longitudinally rocking or pivoting manner.

It has been found that patients are most comfortable if they are supported with their torsos and knees slightly elevated in the manner shown in any of FIGS. 1, 2A, 2B, 2C, 4, 6, and 8A, 8B and 8C. This is of course most simply implemented via forming the frame 16 in the undulating manner depicted in any of FIGS. 1, 2A, 2B, 2C, 4, 6, and 8A, 8B and 8C. On the other hand, if a frame formed in an articulated manner similarly to a hospital bed or gurney were to be utilized, it is important to realize that the patient's torso should not be oriented in a substantially vertical position. This is because in such a case the desired variation of instant blood pressure values in torso, neck and head would be significantly reduced.

As noted above, rhythmic modulation of blood flow into torso, neck and head portions of a patient's cardiovascular system is believed herein to occur as a result of gravity effects. Simply put, blood rushes from the lower limbs toward and into the torso, neck and head as the distal portion of any of the above described longitudinally rocking or pivoting full body length bench assemblies is elevated with respect to the proximal portion, and then reverses when it is lowered. This is naturally accompanied by significant localized changes in blood pressure. By way of example, if the differential elevation between a patient's feet and head is varied over a range of 32 inches there is a corresponding differential rhythmic modulation of blood pressure between the feet and head over a range of about 62 mm Hg. There is less differential rhythmic modulation of blood pressure between the feet and the heart of course because the heart is closer to the feet. Still, in this example of differential elevation between a patient's feet and head being varied over a range of 32 inches the corresponding differential rhythmic modulation of blood pressure between the feet and the heart would perhaps be 45 mm Hg.

As opposed to the above however, it is believed herein that Parkinson's, and possibly other neurological disease patients, may need a different form of treatment that appears to interrupt neural commands that result in the rigidity cited hereinabove. As previously noted, Juan Contreras of Santiago, Chile conceived this form of treatment in basic manual form in order to overcome his extreme rigidity seizures. He referred to this procedure by the coined term "legshaking". As that name implies, the treatment consists of a patient laying in a supine position, and a therapist picking up the patient's legs and shaking them as violently as possible for as long as possible, or at least until his or her seizure subsides.

Figure 10:
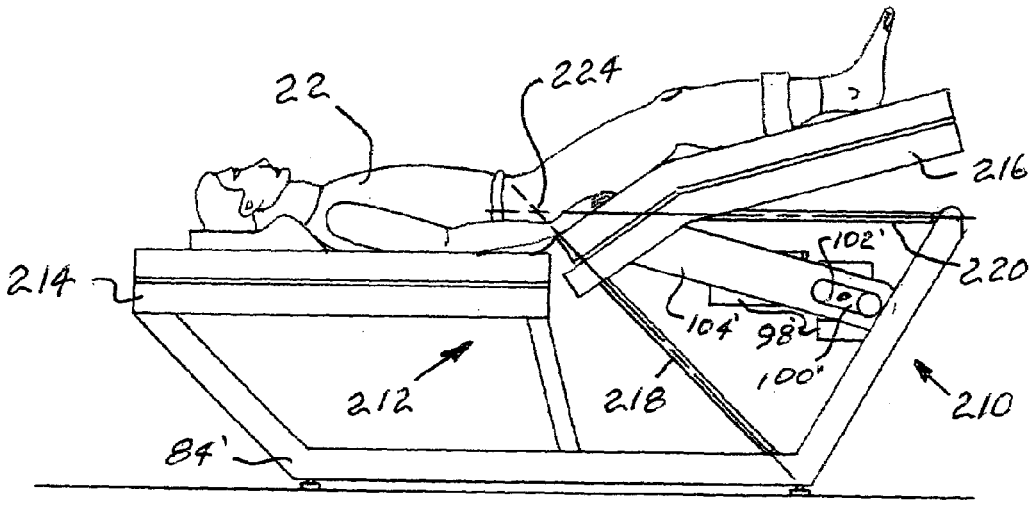
FIG. 10 is a side view of a legshaking apparatus also comprising the Scotch yoke drive assembly.

It is simply not possible for a therapist to implement this procedure for very long. Thus as depicted in FIG. 10, "Legshaking" apparatus 210 capable of implementing the legshaking procedure is presented in a third alternate preferred embodiment of the present invention, wherein apparatus similar to the powered RBPM apparatus of the first alternate preferred embodiment of the present invention is presented. In this case however, a bench assembly 212 is bifurcated with its head and torso-supporting portion 214 being stationary and its leg-supporting portion 216 supported by first and second supporting arms 218 and 220 that are positioned such that a nominal pivot point 222 is formed at a projected nominal center of rotation 224 generally coincident with hip joint of an average patient 22.

As opposed to the RBPM apparatus discussed hereinabove; it is necessary for the Legshaking apparatus 210 to operate at a significantly higher oscillation frequency in order to be effective—even as high as 180 cycles per minute. Even with a limited stroke length such as 6 inches peak-to-peak, such high frequency operation can result is acceleration values of a patient's lower extremities 226 significantly exceeding the acceleration of gravity with acceleration values even approaching 2.5 g's in extreme cases. Thus, it has been found necessary to provide straps 228 for holding the patient's lower extremities 226 in contact with the leg-supporting portion 216 of the bench assembly 212.

Figure 11:
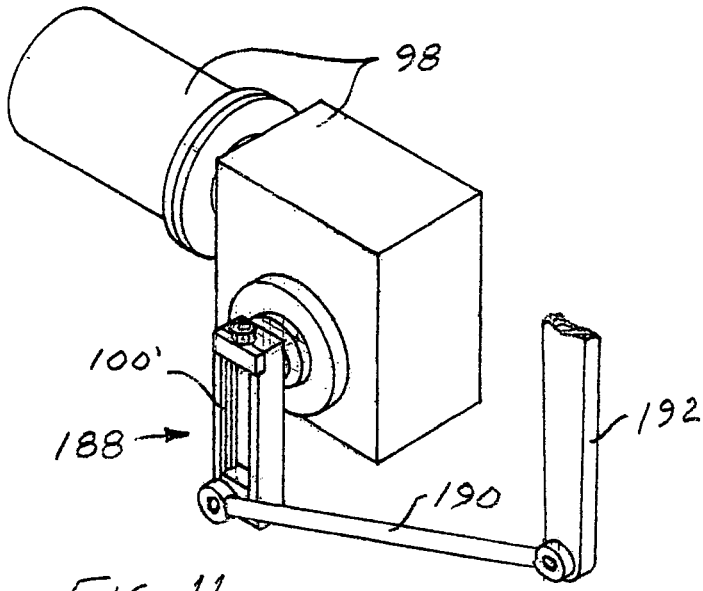
FIG. 11 is a schematic view of a crank and connecting rod drive assembly optionally utilized in place of the Scotch yoke drive assembly.

The bench assembly 82 can be driven by alternate means of course. A crank and connecting rod mechanism 188 depicted in FIG. 11 could alternately be utilized. In such a case, a drive gearmotor 98 would drive another adjustable length crank arm 100' that in turn, would drive a connecting rod 190 and a bench assembly 82' via a bench-mounted drive arm 192.

Figure 12:
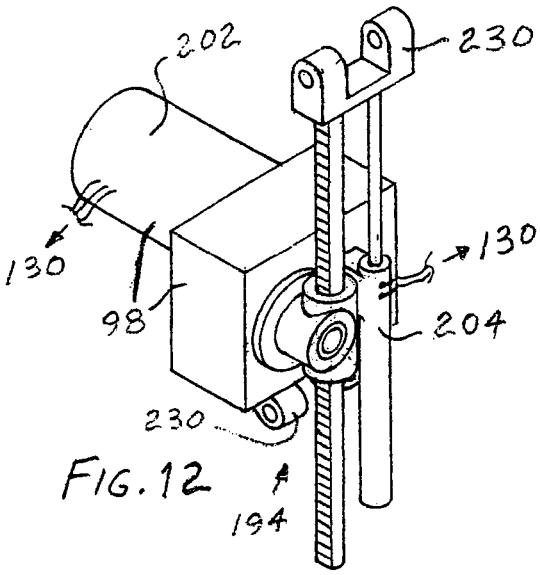
FIG. 12 is a schematic view of a rack and pinion linear drive assembly optionally utilized in place of the Scotch yoke drive assembly.
Figure 13:
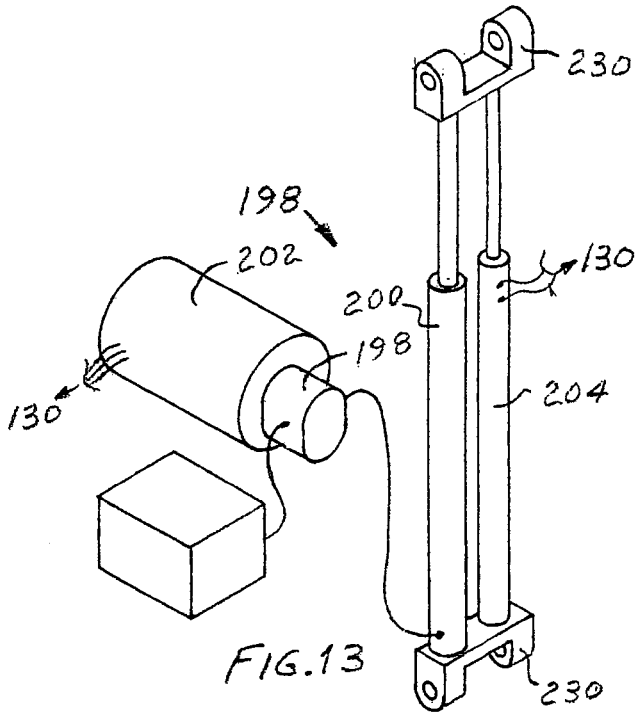
FIG. 13 is a schematic view of a hydraulic drive optionally utilized in place of the Scotch yoke drive assembly.

In a different approach, the desired pivoting motion of such a bench assembly 82' could be attained via drivingly coupling a drive gearmotor 98 to the bench assembly 82' via a linear drive assembly such as a rack and pinion gear set 194 as shown in FIG. 12 or a leadscrew (not shown). Alternately, a hydraulic drive 196 comprising a motor driven pump 198 and cylinder 200 could be utilized to drive the bench assembly 82' as shown in FIG. 13. In any of these examples however, an electronically controlled servomotor 202 would be required wherein control of the servomotor 202 would be affected in concert with signals indicative of instant positions of the bench assembly whereby angular stroke lengths may be selected electronically. In utilizing such an approach however, it must be recognized that absolute fail-safe position measurement and control methods must be incorporated in order to guarantee fail-safe operation. In an exemplary manner for instance, a controller 130 could affect closed-loop control of the servomotor 202 in response to signals indicative of instant positions of either bench assembly 82' issuing from position transducers 204. And of course, devises 230 are required in order to accommodate the pivoting motions of the bench assemblies 82'.

Having described the invention, however, many modifications thereto will become immediately apparent to those skilled in the art to which it pertains, without deviation from the spirit of the invention. For instance, hard pivot points extending above the bench assemblies 82 or 212 could be utilized in place of the virtually determined nominal centers of rotation 90 or 224. Or, any of the first, second or third self-energized resonant RBPM apparatus 10, 140 or 60 could be powered at or near its resonant condition by a low power drive system. It is felt herein however, that to do so would significantly compromise the basic intent of providing the first, second or third self-energized resonant RBPM apparatus 10, 140 and 60 at the lowest cost possible. In any case, such modifications clearly fall within the scope of the invention.

COMMERCIAL APPLICABILITY

It is believed herein that utilization of any of the first, second or third self-energized resonant RBPM apparatus 10, 140, or 60, powered RBPM apparatus 80 and Legshaking apparatus 210 of the present invention would be of significant value to cardiovascularly compromised patients as well as to Alzheimer's, Parkinson's or other neurological disease patients, and therefore, will find broad acceptance both here in America and abroad.

The invention claimed is:

1. A method for the treatment of a disease condition through the use of rhythmic blood pressure modulation (RBPM), said method comprising the steps of:

providing an RBPM apparatus comprising:

a frame configured to retain a patient thereupon along a longitudinal axis so that said patient's head is longitudinally spaced from said patient's feet along said longitudinal axis;

said RBPM apparatus further including a rocker assembly activatible so as to tilt said frame along a pivot axis transverse to said longitudinal axis;

disposing said patient on said frame of said RPBM apparatus so that said patient's head and feet are spaced apart along said longitudinal axis;

activating said rocker assembly so as to tilt said frame about said pivot axis through at least one cycle wherein said patient's feet are raised to a level higher than said patient's head, and lowered to a level below said patient's head;

wherein said cycle causes a rhythmic modulation of the patient's blood pressure so as to create a differential in blood pressure between the patient's head and feet.

2. The method of claim 1, wherein the incline angle between the patient's head and feet during one cycle of the rocker assembly tilting the frame about said pivot axis is as much as 30 degrees.

3. The method of claim 1, wherein said rocker assembly of said RBPM apparatus is self-energized by said patient.

4. The method of claim 3, further including adding weights to either end of said RBPM apparatus in order to compensate for anatomical differences in weight distribution between different patients.

5. The method of claim 1, further including a motor coupled to said rocker assembly.

6. The method of claim 5, wherein said rocker assembly is activated by said motor.

7. The method of claim 5, further including a drive assembly coupled to said motor and said rocker assembly, said drive assembly selected from the group consisting of Scotch yoke mechanism, crank and connecting rod mechanism, liner drive mechanism and hydraulic drive mechanism.

8. The method of claim 7, wherein said drive assembly includes the crank and connecting rod mechanism.

9. The method of claim 1, wherein the disease condition is Parkinson's disease.

10. The method of claim 1, wherein the disease condition is Alzheimer's disease.

11. A method for the treatment of a disease condition through the use of rhythmic blood pressure modulation (RBPM), said method comprising the steps of:

providing an RBPM apparatus comprising:

a frame configured to retain a patient thereupon along a longitudinal axis so that said patient's head is longitudinally spaced from said patient's feet along said longitudinal axis;

said RBPM apparatus further including a rocker assembly activatible so as to tilt said frame along a pivot axis transverse to said longitudinal axis;

said RMPM apparatus further including a motor energizable to activate said rocker assembly;

disposing said patient on said frame of said RPBM apparatus so that said patient's head and feet are spaced apart along said longitudinal axis;

energizing said motor so as to activate said rocker assembly and thereby tilt said frame about said pivot axis through at least one cycle wherein said patient's feet are raised to a level higher than said patient's head, and lowered to a level below said patient's head;

wherein said cycle causes a rhythmic modulation of the patient's blood pressure so as to create a differential in blood pressure between the patient's head and feet.

12. The method of claim 11, wherein said activated rocker assembly tilts said frame about said pivot axis through a plurality of cycles wherein said patient's feet are raised to a level higher than said patient's head, and lowered to a level below said patient's head;

wherein said cycles cause a rhythmic modulation of the patient's blood pressure so as to create a differential in blood pressure between the patient's head and feet during each cycle.

13. The method of claim 11, further including a drive assembly coupled to said motor and said rocker assembly, said drive assembly selected from the group consisting of Scotch yoke mechanism, crank and connecting rod mechanism, liner drive mechanism and hydraulic drive mechanism.

14. The method of claim 13, wherein said drive assembly includes the crank and connecting rod mechanism.

15. The method of claim 11, wherein the disease condition is Parkinson's disease.

16. The method of claim 11, wherein the disease condition is Alzheimer's disease.

* * * * *